United States Patent [19]

Shinjo

[11] Patent Number: 5,022,084

[45] Date of Patent: Jun. 4, 1991

[54] SPEAKER

[76] Inventor: Yasuhiro Shinjo, Shimashidanchi 4-102, 2,654-banchi, Aza-shimashi, Ginowan-chi, Okinawa-ken, 901-22, Japan

[21] Appl. No.: 303,800

[22] Filed: Jan. 30, 1989

[30] Foreign Application Priority Data

Feb. 26, 1988 [JP] Japan ..... 63-45478
Aug. 17, 1988 [JP] Japan ..... 63-205437

[51] Int. Cl.[5] ..... H04R 25/00

[52] U.S. Cl. ..... 381/202; 181/161; 381/152

[58] Field of Search ..... 381/152, 203, 204, 197; 181/167, 161, 173, 169, 170

[56] References Cited

U.S. PATENT DOCUMENTS

| | | | |
|---|---|---|---|
| 1,554,794 | 10/1922 | DeForest | 381/204 |
| 1,717,146 | 6/1929 | Crouch | 181/169 |
| 1,790,679 | 2/1931 | Seely | 181/169 |
| 1,817,630 | 8/1931 | Kroesen | 350/120 |
| 2,868,894 | 1/1959 | Schultz | 381/202 |
| 3,674,946 | 7/1972 | Winey | 381/203 |
| 3,937,905 | 2/1976 | Manger | 381/195 |
| 4,029,171 | 6/1977 | Manger | 181/167 |
| 4,343,376 | 8/1982 | Tsukagoshi et al. | 181/167 |

FOREIGN PATENT DOCUMENTS

| | | | |
|---|---|---|---|
| 59-17797 | 1/1984 | Japan | 181/167 |

*Primary Examiner*—Forester W. Isen
*Assistant Examiner*—M. N. McGeary, III
*Attorney, Agent, or Firm*—Jordan and Hamburg

[57] ABSTRACT

An elastic material such as rubber is employed as the material of a diaphragm and the diaphragm is constructed in such a state that tension is made to exist intrinsically therein, whereby the vibration of the diaphragm when the vibration is applied to it has a large amplitude at the center thereof, gets smaller when approaching the perimeter thereof and finally reaches zero at the edge portion. Accordingly, almost no phenomenon occurs in which air in front and air in the rear of the diaphragm interfere with each other, a speaker box is not required and a tone of good quality may be reproduced.

2 Claims, 7 Drawing Sheets

SPEAKER

BACKGROUND OF THE INVENTION

The present invention relates to a speaker that has a unique diaphragm.

There are several types of speakers that have been heretofore used including a moving coil type speaker, but a diaphragm is provided as one element thereof in any case.

The diaphragm which has been used so far is composed of what is called a rigid body formed with nonelastic material such as paper into a cone shape.

In a diaphragm made of a rigid body as described above, a shearing phenomenon is presented between the air contacting the diaphragm directly and the air existing in the peripheral end area of the diaphragm when the diaphragm vibrates. As a result, the air in front and the air in the rear of the diaphragm interfere (negates) with each other, and this phenomenon becomes remarkable particularly in the bass region. Accordingly, the speaker is generally housed in a housing in order to suppress such a phenomenon to a certain extent, but it is still impossible to suppress such a phenomenon completely, thus deteriorating the tone quality.

SUMMARY OF THE INVENTION

It is an object of the present invention to provide a speaker which dissolves drawbacks of the conventional technique described above and has no mutual interference of the air in front and in the rear of the diaphragm.

The abovementioned object of the present invention may be attained by adopting the following means. That is, there is provided a speaker characterized in that a diaphragm composed of an elastic material such as rubber is held in a configuration such that tension exists in the diaphragm, and a central member composed of a rigid material is attached at the center of the diaphragm, whereby it is easy both to apply tension to the diaphragm and to connect the diaphragm with a converter such as a voice coil.

DESCRIPTION OF THE PREFERRED EMBODIMENTS

In a speaker according to the present invention, a diaphragm 1 composed of an elastic material such as rubber is stretched on an outer frame 2 having an annulus ring shape or a square annulus shape and the central portion thereof is connected with a converter 3 such as a voice coil through a coupling portion 4.

Figure 1:
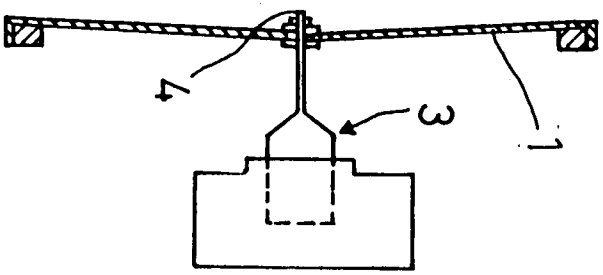
FIG. 1 is a structural explanatory view of a speaker according to the present invention.
Figure 2:
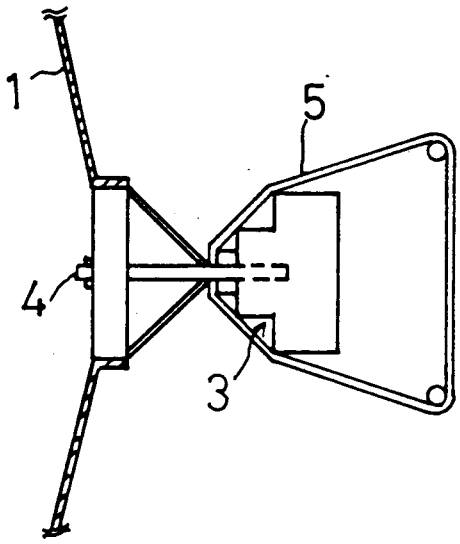
FIG. 2 is a structural explanatory view of another embodiment of a speaker according to the present invention.

Furthermore, the diaphragm 1 is installed under such a condition that tension exists intrinsically therein when it is stretched on the outer frame 2. Otherwise, after the diaphragm is stretched on the outer frame 2, a tension vesting piece 5 such as a spring or a rubber band, etc., is disposed as shown in FIG. 2 so as to result in producing tension in the diaphragm 1.

When the diaphragm 1 made of an elastic material which is stretched under such a condition that tension exists intrinsically therein is vibrated by the converter 3, the vibrating state at that time is such that the central portion of the diaphragm 1 has the maximum amplitude, the amplitude becomes smaller as one approaches the peripheral edge portion of the diaphragm 1, and the amplitude becomes zero at the fixed portion with the outer frame 2. Accordingly, no shearing phenomenon is generated between the air contacting the diaphragm 1 directly and the air around the diaphragm 1, resulting in no mutual interference between the air in front and in the rear of the diaphragm 1.

Furthermore, among vibrations applied to the diaphragm 1, the vibration for bass that has a low frequency tends to be transmitted close to the peripheral end area of the diaphragm 1 against the tension existing intrinsically in the diaphragm 1, but the vibration for a high-pitched tone that has a high frequency tends not to be transmitted so far to the peripheral end area because the transmittance thereof is suppressed by the tension existing in the diaphragm 1. Accordingly, when vibrations of various compasses are transmitted to the diaphragm 1, such a state is created that the vibration in the high compass is laid on top of the vibration in the low compass, and natural tone quality in which various compasses are fixed may be reproduced.

According to the present invention, a central member composed of a rigid material such as hard paper, plastic, wood or metal is attached in some cases in such a configuration as to integrate it with the diaphragm at the central portion of the diaphragm composed of elastic material as described above. By doing so, it becomes easy to maintain an internal tension which is appropriate for the diaphragm under a uniform condition.

The present invention will be described in detail hereinafter with reference to specific embodiments.

EXAMPLE 1

Figure 3:
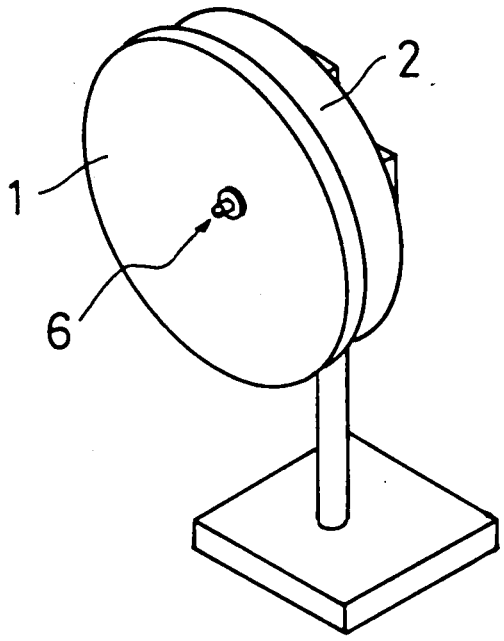
FIG. 3 is a perspective view showing Example 1 of the present invention.
Figure 4:
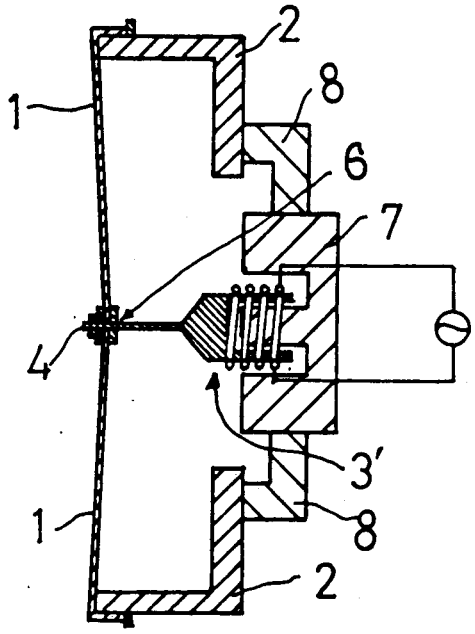
FIG. 4 is an explanatory view of the internal structure of the speaker shown in FIG. 3.

In Example 1, a diaphragm 1 made of rubber is stretched on an outer frame 2 in such a configuration as to include tension intrinsically therein as shown in FIG. 3. As shown in FIG. 4 which shows the internal structure thereof, the diaphragm 1 is provided with a hole 6 for fitting a voice coil 3' at the center thereof, and a coupling portion 4 of the voice coil 3' is inserted through hole 6 so as to couple the diaphragm 1 with the voice coil 3'. Besides, in FIG. 4, numeral 7 denotes a permanent magnet, and 8 denotes a frame body.

When various tones were reproduced with the speaker of Example 1 having the above-described structure, a tone of a very good quality was reproduced over a wide compass without employing a housing.

EXAMPLE 2

Figure 5:
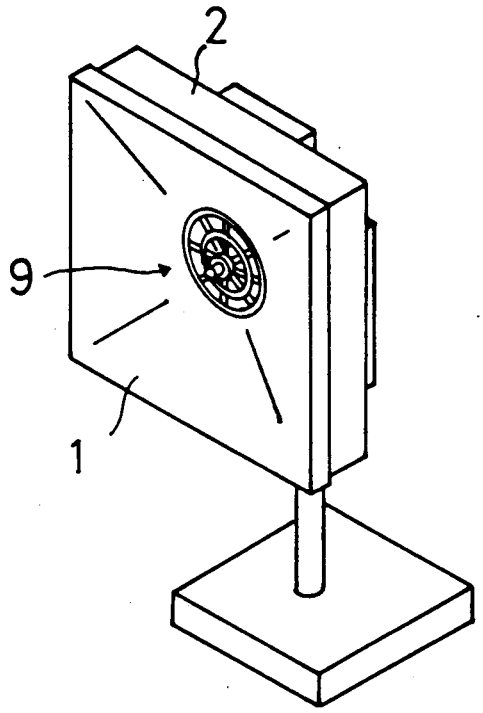
FIG. 5 is a perspective view showing Example 2 of the present invention.
Figure 6:
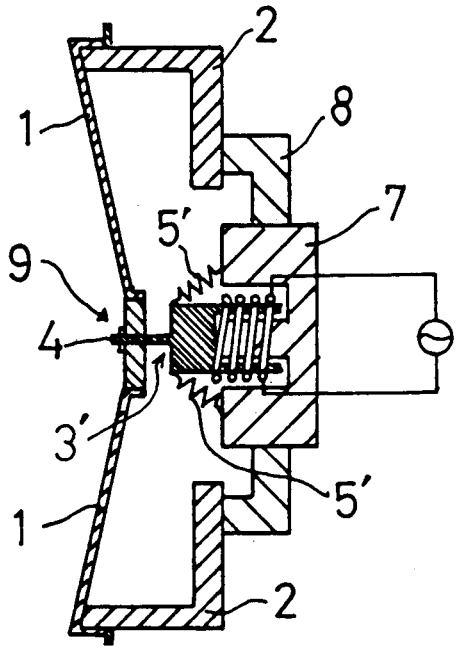
FIG. 6 is an explanatory view of the internal structure of the speaker shown in FIG. 5.

As to Example 2, as shown in FIG. 5 which is a perspective view of a speaker according to Example 2 and FIG. 6 which is an explanatory view of the internal structure thereof, a rigid central member 9 composed of plastic is fitted at the center of the diaphragm 1 made of rubber of Example 2 so as to be integrated with the diaphragm 1. Tension of the diaphragm 1 is applied to some extent when it is stretched on the outer frame 2, but the inner structure thereof is formed in such a manner that a spring 5' is disposed in the rear of central member 9 and the fixed portion between the diaphragm 1 and the coupling portion 4 is pulled to the rear of the diaphragm so that an appropriate tension is applied to the diaphragm 1 as shown in FIG. 6. In the speaker according to Example 2, it is possible to obtain an appropriate tension of the diaphragm 1 by adjusting the tensile force of the spring 5'.

With the speaker of Example 2 having the above-mentioned structure, a tone of very good quality can also be reproduced over a wide compass without using a housing similarly to Example 1.

EXAMPLE 3

Figure 7:
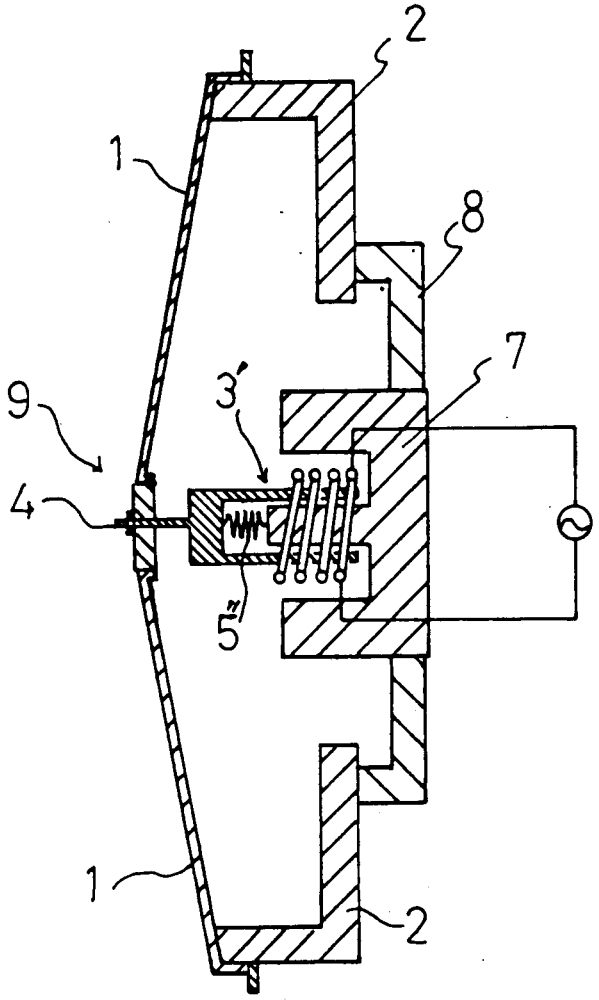
FIG. 7 is an explanatory view of the internal structure of Example 3 of the present invention.

As shown in FIG. 7 which shows the internal structure, Example 3 has such a structure that a spring 5'' which pushes the diaphragm 1 forward is disposed in the rear of the diaphragm 1 and the central portion of the diaphragm 1 is maintained in such a configuration that the central portion of the diaphragm 1 is made to project slightly forward thereby to apply tension to the diaphragm 1. With the speaker according to Example 3, it is also possible to obtain an appropriate tension of the diaphragm 1 by adjusting the pressing force of the spring 5'' similarly to Example 2.

With the speaker according to Example 3 having the above-described structure, a tone of very good quality can be reproduced over a wide compass without using a housing, and furthermore, it is possible to expand the tone toward a wider direction.

As described above, according to the present invention, the diaphragm itself is composed of an elastic material and a condition of maintaining tension inside is obtained. Accordingly, there occurs almost no shearing phenomenon between the vibrating air and the fixed air which has always occurred in a conventional speaker which employed a diaphragm made of a rigid material. Thus, a tone of good quality may be reproduced without using a housing, and a tone of wide compass may be reproduced with a single diaphragm only, whereby a thin, light-weight and compact unit may be obtained. Furthermore, the diaphragm and the converter are coupled with each other at the central portion only and easily detached from each other. Therefore, a desired tone quality is obtainable simply by replacing the diaphragm with one having a different thickness of the elastic body forming the diaphragm and tension existing therein.

What is claimed is:

1. A speaker comprising a diaphragm consisting of an elastic material, and tension means mounting said diaphragm in a stretched configuration such that a state of intrinsic tension exists within said diaphragm, wherein said diaphragm has a central opening, and further comprising a rigid central member fitted in the central opening of said diaphragm and integrally formed with said diaphragm, converter means, and coupling means interconnecting said rigid central member and said converter means, said tension means comprising tension vesting means for producing said intrinsic tension within said diaphragm through said coupling means and said rigid central member, said tension vesting means comprising spring means providing a pressing force against said coupling means to hold said diaphragm in said state of intrinsic tension through said rigid central member.

2. A speaker according to claim 1, further comprising adjusting means for adjusting the pressing force of said spring means.

* * * * *